US005617842A

United States Patent [19]

Champion

[11] Patent Number: 5,617,842

[45] Date of Patent: Apr. 8, 1997

[54] FIREPLACE WITH OUTER HOUSING COOLING SYSTEM

[75] Inventor: Mark R. Champion, Huntington, Ind.

[73] Assignee: The Majestic Products Company, Huntington, Ind.

[21] Appl. No.: 377,399

[22] Filed: Jan. 24, 1995

Related U.S. Application Data

[63] Continuation-in-part of Ser. No. 202,785, Feb. 28, 1994, abandoned.

[51] Int. Cl.[6] ..... F24B 1/188

[52] U.S. Cl. ..... 126/528; 126/523

[58] Field of Search ..... 126/531, 528, 126/529, 530, 523, 77

[56] References Cited

U.S. PATENT DOCUMENTS

| | | | |
|---|---|---|---|
| 3,538,909 | 11/1970 | Migues . | |
| 3,601,117 | 8/1971 | Carson . | |
| 3,724,443 | 4/1973 | Carson . | |
| 4,003,362 | 1/1977 | Lener . | |
| 4,013,059 | 3/1977 | Andrews . | |
| 4,060,068 | 11/1977 | Lever et al. . | |
| 4,153,036 | 5/1979 | Billmeyer et al. | 126/531 |
| 4,349,009 | 9/1982 | Patterson et al. . | |
| 4,909,227 | 3/1990 | Reiger | 126/527 |
| 5,339,797 | 8/1994 | Maitland | 126/523 X |

*Primary Examiner*—Carl D. Price
*Attorney, Agent, or Firm*—Baker & Daniels

[57] ABSTRACT

A fireplace with a cooling air passageway within the fireplace housing that maintains the forward portion of the housing top wall cool during operation. The fireplace includes a combustion chamber, a flue, and an outer housing that encloses the combustion chamber. Plenums formed between the walls of the outer housing and the combustion chamber walls are used to circulate room air to keep the housing cool. Disposed within a forward portion of the upper plenum above the combustion chamber is a passageway constricting baffle. The baffle constricts the cross-sectional area of the upper plenum through which the cooling air flows and forces the cooling air flow upwardly against the underside of the housing outer top wall, thereby cooling this portion of the housing which typically is difficult to keep cool. The fireplace also includes a baffle which directs cooling air outlet from the upper plenum to a venturi passageway in communication with the flue. The baffle and passageway cooperate to induce a draft of cooling air through the upper plenum when access doors to the combustion chamber are either open or closed.

13 Claims, 2 Drawing Sheets

FIREPLACE WITH OUTER HOUSING COOLING SYSTEM

CROSS-REFERENCE TO RELATED APPLICATIONS

This application is a continuation-in-part of application Ser. No. 08/202,785, filed Feb. 28, 1994, now abandoned. The disclosure of this application is expressly incorporated by reference.

BACKGROUND OF THE INVENTION

This invention relates to a fireplace, and, in particular, to a cooling passageway disposed within an air-cooled housing enclosing the combustion chamber of the fireplace.

Known in the art are a multitude of different types of combustion apparatus, including fireplaces such as free-standing models and zero clearance models. These models of fireplaces, and most particularly zero clearance fireplaces, commonly include housings or shells formed of conductive material such as sheet metal that surround the combustion chambers or fireboxes whereat combustion of fuel occurs and include a transparent glass door assembly. The walls of the housing are typically constructed in spaced relationship with some or all of the walls of the combustion chamber, including the bottom wall and top wall which form the floor and ceiling of the combustion chamber. The resulting space or plenums provided between the combustion chamber and housing permits the formation of passageways suitable to circulate air. Existing fireplaces have used these passageways to circulate air to serve a number of nonexclusive purposes, including the cooling of the exterior of the housing. Keeping the outer housing cool is of significant importance in zero clearance fireplaces where the materials externally adjacent the housing may be combustible.

One problem with some existing fireplaces is that under certain operating condition not enough air to cool the housing to a desirable level flows through the cooling passageways. In a known fireplace construction which uses an induced draft within a cooling passageway, rather than a forced draft created by a fan, air from an upper plenum of the cooling passageway which is disposed above the fireplace combustion chamber discharges directly into the forward region of the combustion chamber. This outlet air then passes rearwardly through the combustion chamber to mix with the combustion products and then pass into the flue. While in such a construction cooling air is drawn through the cooling passageway when the combustion chamber access doors are closed, conditions within the combustion chamber are such that induced air flow through the upper plenum is severely curtailed or halted when the access doors are open. Consequently, when the fireplace doors are open during operation, the stagnated air within the cooling passageway increases in temperature over time due to the heat radiating from the combustion chamber, and an undesirable increase in the temperature of the outer housing ultimately results.

Another problem with some existing fireplaces pertains to their inability to maintain at relatively low temperatures the upper forward portion of the outer housing. This problem often persists despite the fact that a cooling air plenum above the combustion chamber is provided. In particular, the air within the cooling passageway upper plenum is frequently discharged or routed downwardly in the direction of the combustion chamber. Because hotter air rises, the air within the upper plenum more inclined to be drawn through the upper plenum is the air closer to the outlet, that is, the cooler air flowing near to the combustion chamber. The hotter air which migrates upwardly tends to stagnate in the upper forward portion of the outer housing, raising the temperature thereof, when the induced draft through the plenum is not strong enough to pull the entire volume of air through the upper plenum.

What is needed in the art is a fireplace having an air-cooled outer housing which promotes adequate cooling of the forward portion of the top wall of the outer housing.

An additional need is a fireplace having an air-cooled outer housing which is adequately cooled by an induced draft of cooling air when the access doors to the combustion chamber are either open or closed.

SUMMARY OF THE INVENTION

The present invention provides a fireplace with an outer housing that encloses a cooling air passageway structured to cool the forward portion of the outer housing top wall during operation. The inventive cooling system advantageously effects an induced draft of room air through the cooling air plenum disposed above the combustion chamber even when the fireplace access doors to the combustion chamber are open. In one form thereof, the fireplace of the present invention includes a combustion chamber in which the fuel is combusted and the products of combustion are created, the combustion chamber including an opening through which combustion air is introduced and further comprising a top wall, a bottom wall, a rear wall and opposing side walls. A flue is positioned for exhausting the products of combustion from the combustion chamber. The housing comprises a plurality of outer walls, at least one of the plurality of housing outer walls disposed in spaced apart relationship with a corresponding combustion chamber wall to form at least one plenum. A cooling air inlet is in flow communication with the plenum, and the plenum comprises an upper plenum disposed between the outer top wall and the combustion chamber top wall. There is provided a passageway constricting baffle disposed within a forward portion of the upper plenum, the baffle being sized and arranged to constrict a cross-sectional area of the upper plenum through which cooling air flows and force the flow of cooling air passing through the upper plenum upwardly toward the housing outer top wall.

An advantage of the cooling system of the present invention is its ability to cool the outer housing with an induced draft of room air when the combustion chamber access doors are open.

Another advantage of the cooling system of the present invention is that the cooling air is directed over the forward inner portion of the top wall of the outer housing to ensure adequate cooling thereof.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate preferred embodiments of the invention, and such exemplifications are not to be construed as limiting the scope of the invention in any manner.

DESCRIPTION OF THE PREFERRED EMBODIMENT

Figure 1:
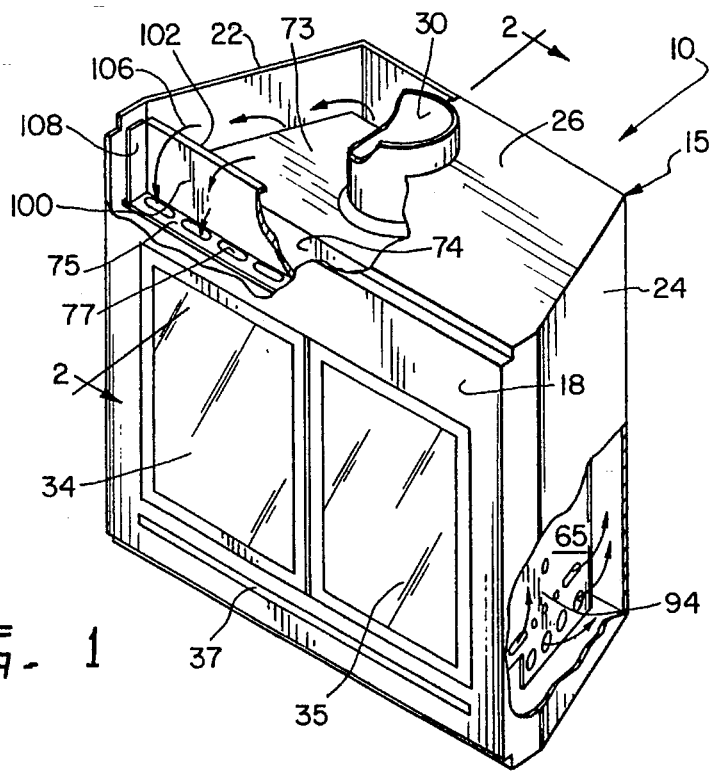
FIG. 1 is a fragmentary perspective view of an embodiment of the present invention showing a zero clearance fireplace including the cooling system of the present invention, wherein portions of the fireplace are removed to illustrate cooling air passageways and a passageway constricting baffle.
Figure 2:
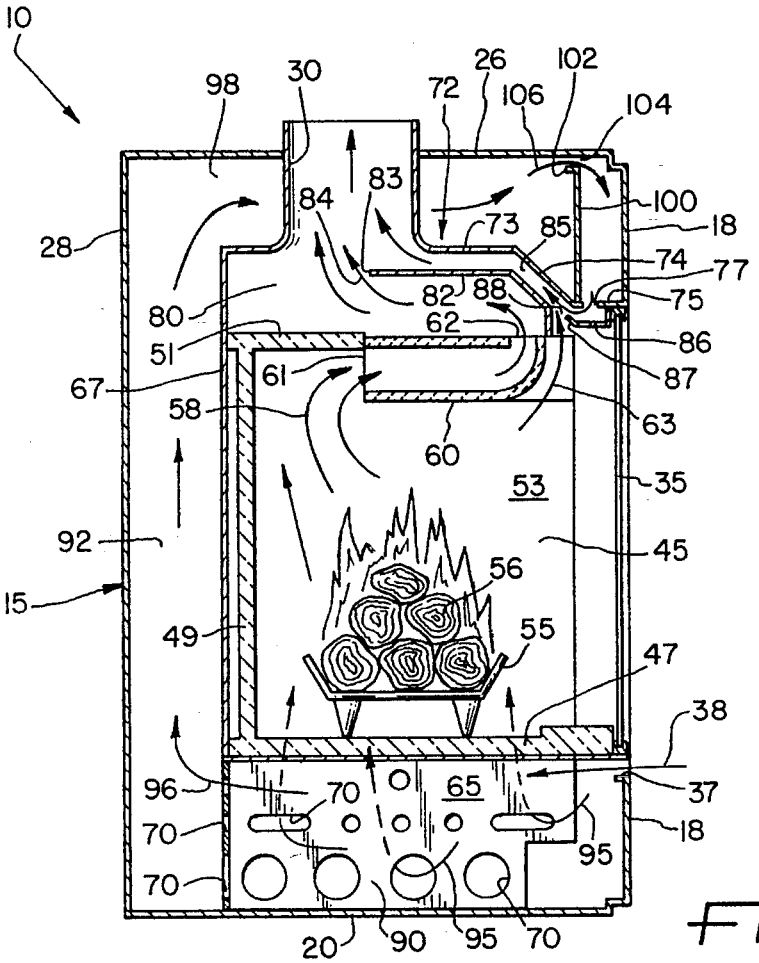
FIG. 2 is a cross-sectional side view, taken along line 2—2 of FIG. 1, of the zero clearance fireplace with cooling system.

Referring now to FIGS. 1 and 2, there are respectively shown a fragmentary perspective view and a cross-sectional view of a zero clearance fireplace with a cooling system for the outer housing of the present invention. While the fireplace is shown and further explained herein with reference to a zero clearance, wood-burning fireplace product, the described embodiment is merely illustrative of one type of beneficial application of the present invention. The present invention is envisioned finding useful application with other fireplace units, for instance gas appliances, where the cooling of the outer housing effected by the cooling system is beneficial. In addition, the particular overall shape and construction of the zero clearance fireplace shown in not material to the present invention, and those of skill in the art will appreciate that an assortment of modifications to the fireplace can be provided while still utilizing the teachings of the present invention.

The zero clearance fireplace, generally designated 10, includes an outer shell or housing, generally designated 15, sized and shaped to closely fit within a building hollow which may be defined by combustible materials such as wood. Housing 15 is essentially formed of sealingly interconnected steel plates to provide front surface or wall 18, bottom wall 20, opposing side walls 22, 24, top wall 26, and rear wall 28. Housing top wall 26 includes an aperture through which flue 30 upwardly projects. Flue 30 can be installed in flow communication to a chimney stack of the building to allow products of combustion produced within fireplace 10 during operation to be exhausted to the outside atmosphere.

As shown in FIG. 1, an opening in front wall 18 for accessing the combustion chamber enclosed within housing 15 is covered with any suitable openable closure device known in the art, such as a standard set of transparent glass doors 34, 35 shown which are hingedly mounted in a well known manner. A series of individual elongate inlets or apertures 37, represented abstractly in FIG. 1, are provided in the bottom portion of front wall 18 and extend substantially the entire forward width of housing 15. Inlets 37 allow room air, as indicated by arrow 38 in FIG. 2, to be drawn into and serve to cool housing 15 in a manner described more fully below.

Referring now to FIG. 2, combustion chamber 45 and the associated products of combustion exhaust conduits are positioned internally of housing 15. Combustion chamber 45 is formed by bottom wall or floor 47, rear wall 49, top wall or ceiling 51, a far side wall 53, and an opposing side wall, not shown, all made of refractory materials. The opening in housing 15 covered by glass doors 34, 35 allows combustion air to be introduced or enter into combustion chamber 45 from the room in which fireplace 10 is installed. Combustion air could alternatively be provided through other openings or inlets, for example openings in the side walls of combustion chamber 45 connected by conduits to either room air or an outside air source. Grate 55, in which fuel such as wood logs 56 can be stacked and combusted to create products of combustion, is typically supported by chamber floor 47 and located at the center of the side-to-side width of combustion chamber 45. Additional fuel 56 can be added to grate 55 through the closure device covered opening. The initial flow path of the combustion products out of combustion chamber 45 is indicated generally by upward arrows 58 within chamber 45.

Referring now to FIG. 2, combustion chamber top wall 51 extends the full width of combustion chamber 45 near its rear region. Positioned forward of the rear region of top wall 51 is a ceramic fiber duct 60, described more fully in the parent application, which is inserted in an appropriately sized aperture in top wall 51. Duct 60 includes a rearwardly facing inlet 61, into which the products of combustion near the rear of the chamber and indicated at 58 are drawn, connected via a circuitous passageway to a horizontally disposed outlet 62. Duct 60 also includes a second duct portion positioned toward the front of combustion chamber 45. The second duct portion allows removal of products of combustion, referenced as 63, which may roll toward the front of combustion chamber 45 during operation.

Figure 3:
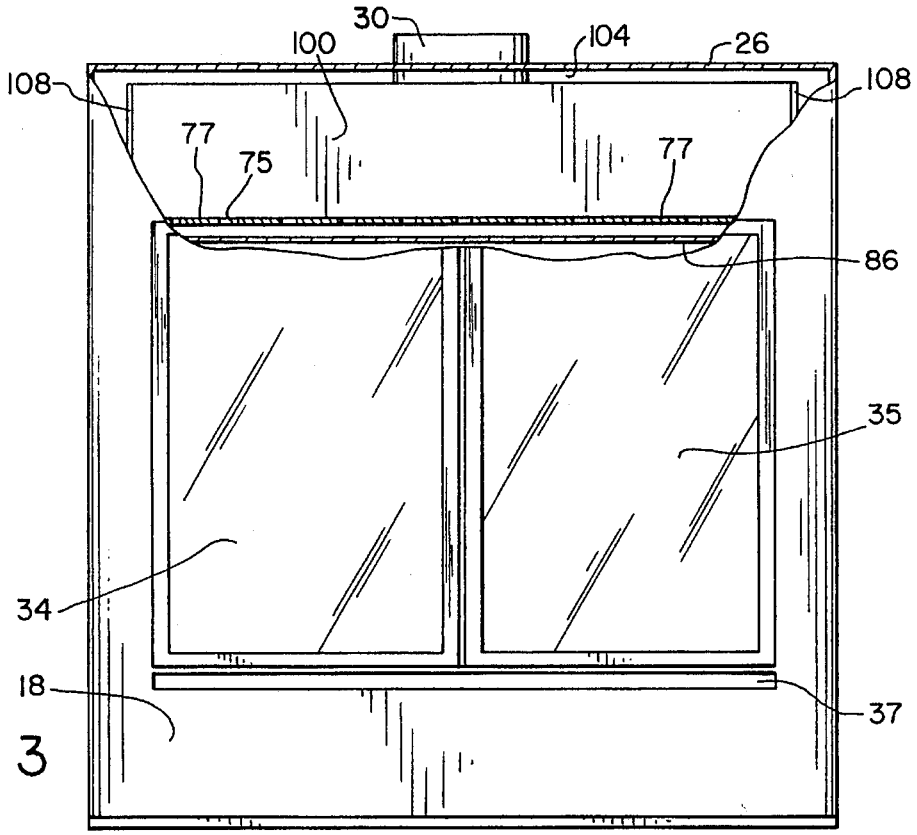
FIG. 3 is a fragmentary front view of the zero clearance fireplace of FIG. 1 with a portion removed to illustrate the cooling system air passageway constricting baffle.

Vertically aligned flue 30 is located above and in fluid communication with combustion chamber 45 and duct 60. Flue 30 projects upwardly from a combustion dome, generally designated 72, made of an aluminized steel plate. The two lateral edges and rear edge of combustion dome 72 are sealingly connected, such as by welding, to the top edges of right combustion casing 65 (See FIG. 1), a left combustion casing panel, not shown, and rear combustion casing panel 67 respectively, which are described more fully below. Combustion dome 72 includes a horizontal planar region 73 extending both forward and rearward of flue 30, an angled baffle region 74, and a forward flange 75 which may be connected in an air-tight manner to outer housing front wall 18. As shown in FIG. 3, a row of elongate openings 77 are provided along the length of flange 75. Combustion dome 72 and the regions of the combustion casing panels which upwardly extend above combustion chamber 45 cooperate to define chamber 80. Double angled diverter plate or bypass panel 82 is disposed within chamber 80 at a position beneath and in spaced apart relationship with combustion dome 72. Distal edge 83 of double angled diverter plate 82 juts rearwardly into the flow path of combustion products upwardly passing into flue 30, and plate 82 is particularly structured and arranged proximate the angled region of combustion dome 72 to create venturi passageway 85 therebetween within chamber 80.

In the embodiment shown in FIGS. 1–3, disposed at the upstream end of venturi passageway 85 is a cooling air baffle 86, with an upwardly extending rearward lip 87. Cooling air baffle 86, which extends the length of combustion dome flange 75 and is attached at its forward end to flange 75, prevents the cooling air flowing downwardly through openings 77 from passing directly into combustion chamber 45 and instead redirects this cooling air toward venturi passageway 85. Ending at a location rearward of openings 77, lip 87 is spaced from a coplanar region of double angled diverter plate 82 to define an opening 88 through which combustion products at arrow 63 enter venturi passageway 85. While the ratio of the size of opening 88 to the gap between lip 87 and flange 75 through which cooling air flows rearwardly may be varied within the scope of the invention, it will be appreciated that increasingly larger sizes of openings 88 decreases the amount of cooling air drawn through openings 77, which results in less cooling being pulled through the cooling passageways within outer housing 15.

In the shown embodiment, combustion chamber 45 is attached to and supported in spaced relationship above housing wall 20 by rear combustion casing panel 67 as well as similarly shaped and opposing right and left combustion casing panels 65. Only the right casing panel 65 is shown in the Figures. Panels 65, 67 are interconnected or possibly integrally formed aluminized steel plates that flank the opposing sides walls and rear wall 49 of combustion chamber 45. Combustion casing panels 65, 67 are secured along their lower edges to outer housing bottom wall 20.

The positioning of combustion chamber 45 above housing wall 20 defines lower plenum 90 therebetween. The shown spacing of the combustion casing panels 65 67 relative to outer housing 15 also creates a rear plenum 92 between outer housing rear wall 28 and rear combustion casing panel 67, a first side plenum 94 (See FIG. 1) between outer housing side wall 24 and right combustion casing panel 65, and an opposite side plenum, not shown, between outer housing side wall 22 and the left combustion casing panel. As shown in both FIGS. 1 and 2, a multitude of variously shaped and arranged holes 70 are provided through each of the combustion casing panels at a height below combustion chamber bottom wall 47. Holes 70 permit air drawn into lower plenum 90 through inlets 37 to flow into side plenum 94 and the opposite side plenum as indicated by arrows 95, as well to flow into rear plenum 92 as indicated by arrow 96.

Outer housing top wall 26 is in spaced apart relationship with combustion dome 72 so as to define upper plenum 98 therebetween above combustion chamber 45. Upper plenum 98 is, in other words, in fluid communication with rear plenum 92 as well as the side plenums. The above-described configuration of plenums achieves a number of cooling air passageways through which room air is drawn during fireplace operation to effect a cooling of the outer housing 15. For example, lower plenum 90, rear plenum 92 and top plenum 98 cooperate to form a generally C-shaped flow path for room air which during operation will cool the housing bottom wall 20, housing rear wall 28, and housing top wall 26. Side plenum 94, as well as the opposite side plenum, also cooperates with lower plenum 90 and top plenum 98 to form an air flow passageway for cooling air. While multiple, defined flow paths are shown herein, it will be appreciated that the cooling system can properly function to cool the upper outer housing with alternate or fewer cooling air passageways.

Referring to FIGS. 1–3, positioned within upper plenum 98 at the downstream or forward end thereof is upstanding baffle 100. Baffle 100 better promotes cooling of the forward portion of outer housing top wall 26 by effectively constricting the cross-sectional area of air flow of upper plenum 98 and forcing cooling air therein into contact with the outer housing as the air passes baffle 100. Vertically extending baffle 100 is attached at its lower end to combustion dome 72 at a location directly rearward of openings 77. The upper edge of baffle 100, which includes a rearwardly projecting lip 102 for rigidity, is spaced from the inner surface of outer housing top wall 26 to provide a slot shaped gap 104 therebetween. Cooling air indicated at 106 can pass through gap 104 into the compartment forward of baffle 100, and then pass through downwardly directed openings 77. It will be appreciated that the portion of the cooling air within upper plenum 98 which is the hottest and which has naturally migrated upwardly to the underside of housing top wall 26 will be forced through gap 104. Baffle 100 is preferably formed as a solid panel such that the entire volume of cooling air passing through upper plenum 98 must pass through gap 104. As shown in FIG. 3, baffle 100 spans substantially the entire width of upper plenum 98 and is transversely oriented to the flow of cooling air through upper plenum 98.

As best shown in FIGS. 1 and 3, further encircling the row of openings 77 are a pair of baffle flanges 108 which forwardly jut from the opposite lateral edges of the main body of baffle 100 to housing front wall 18. Flanges 108, which are coextensive in height with baffle 100, prevent cooling air from laterally circumventing baffle 100 and force the cooling air which reaches the flanges 108 from, for example, side plenum 94, to travel upwardly over the corner inner surfaces of outer housing 15.

A further understanding of the present invention will result from an explanation of its operation. When fuel 56 in grate 55 is combusted, the generated products of combustion primary pass upwardly as indicated by arrow 58, pass through inlet 61 and outlet 62 of ceramic duct 60, are directed rearwardly in chamber 80 by diverter plate 82, and then pass upwardly through flue 30. At the commencement of combustion, the cooling air within the passageways formed by the plenums between the outer housing and the combustion chamber is generally motionless. As combustion advances, the passing of the combustion products through chamber 80 and past plate edge 83 at arrow 84 creates a low pressure region at the downstream end of venturi passageway 85. Air thereby drawn or conveyed through passageway 85 creates a low pressure region at the upstream passageway end located proximate baffle lip 87. Cooling air baffle 86 establishes flow communication between venturi passageway 85 and openings 77, and consequently the low pressure region draws air within upper plenum 98 through openings 77 and through venturi passageway 85. Air drawn from upper plenum 98 is replenished by air from rear plenum 92 and the side plenums, which is replenished with air from lower plenum 90, which in turn draws air through inlets 37. An induced draft through the various cooling passageways formed by the plenums results. Due to the presence of opening 88, the low pressure of venturi passageway 85 also draws in the flow 63 of combustion products from chamber 45.

Figure 4:
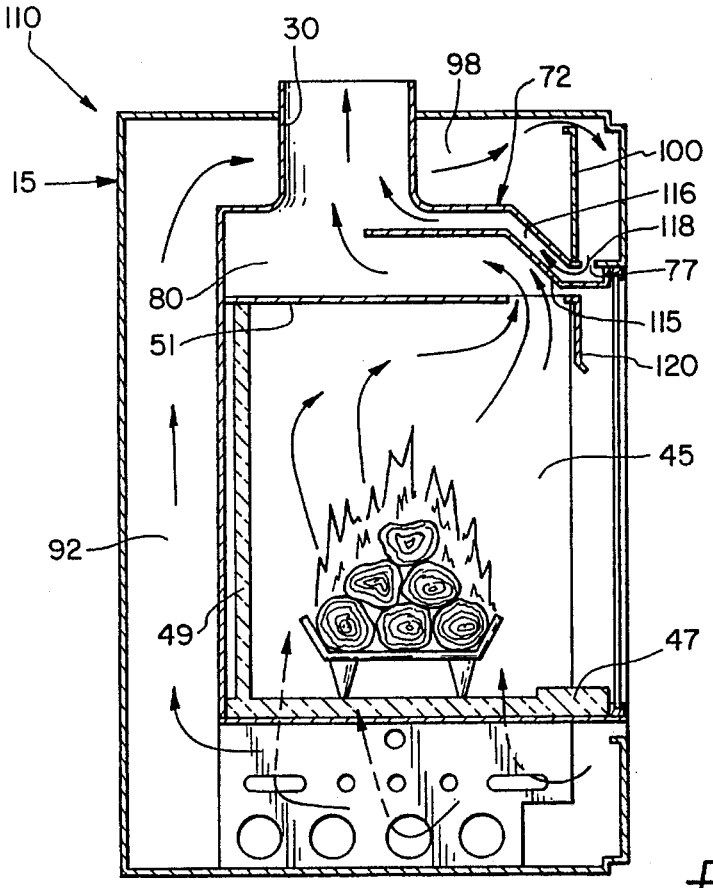
FIG. 4 is a cross-sectional side view of an alternate embodiment of the present invention showing a differently configured zero clearance fireplace including a differently configured cooling system of the present invention.

FIG. 4 discloses another embodiment of the present invention which is similar to the fireplace 10 shown in FIGS. 1–3 in most respects. Fireplace 110 includes a combustion chamber 45 defined in part by floor 47, rear wall 49 and top wall 51. In this embodiment, top wall 51 is formed of sheet-metal and defines an outlet through which the products of combustion are exhausted from combustion chamber 45 at a forward region of the chamber. Disposed exterior of combustion chamber 45 and interior of outer housing 15 is lower plenum 90, rear plenum 92 and upper plenum 98. Passageway constricting baffle 100, which is provided with lateral flanges, not shown, upwardly extends within upper plenum 98.

Mounted below plenum openings 77 for redirecting cooling air venting therefrom is a cooling air baffle assembly, generally designated 115. Baffle assembly 115 is basically the double angled diverter plate and stub shaped cooling air baffle of the embodiment of FIGS. 1–3 combined into a unitary structure into which combustion products do not enter or leak. Baffle assembly 115 is structured complementary to combustion dome 72 to define venturi passageway 116 therebetween. In this embodiment, passageway 116 is air-tight such that only a flow of heated room air which is circulated through upper plenum 98 and through openings 77 as indicated by directional arrow 118 is drawn through venturi passageway 116 by the low pressure region created within chamber 80 by the exhaust flow of combustion products. This flow of room air creates an induced draft through the cooling air passageways in a manner described above with respect to fireplace 10 of FIGS. 1–3. Air flowing through air passageway 116 mixes with combustion products and passes through flue 30 to be externally exhausted.

The underside of baffle 115 forms a passageway above the combustion chamber through which combustion products pass rearwardly into the flue 30. A vertically disposed diverter plate 120 may be also be provided to prevent combustion products from rolling forward into the room being heated and to cooperate with baffle 115 to route the combustion products rearwardly.

While this invention has been described as having preferred designs, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. A fireplace for combusting fuel comprising:

a combustion chamber whereat the fuel is combusted and products of combustion are created, said combustion chamber comprising an intake opening through which combustion air is introduced and an exhaust opening through which the products of combustion are discharged, said combustion chamber further comprising a top wall, a bottom wall, a rear wall, and opposing side walls;

a flue disposed in fluid communication with the exhaust opening of the combustion chamber for exhausting the products of combustion;

a housing comprising a plurality of outer walls, at least one of said plurality of housing outer walls disposed in spaced apart relationship with a corresponding combustion chamber wall to form at least one plenum;

a cooling air inlet in flow communication with said at least one plenum;

wherein said at least one plenum comprises an upper plenum disposed between an outer top wall of said plurality of housing outer walls and said combustion chamber top wall;

a passageway constricting baffle disposed within a forward portion of said upper plenum, said baffle sized and arranged to constrict a cross-sectional area of said upper plenum through which cooling air flows and force the flow of cooling air passing through said upper plenum over the baffle and upwardly toward said housing outer top wall; and a passageway allowing fluid communication between said upper plenum and said flue, wherein the passageway has an upstream end for receiving cooling air which passes over the baffle and a downstream end for exhausting cooling air into the flue.

2. The fireplace of claim 1 wherein said passageway constricting baffle comprises an upstanding panel including an upper end spaced from the underside of said housing outer top wall.

3. The fireplace of claim 1 wherein said passageway constricting baffle comprises an upstanding panel transversely disposed to the flow of cooling air through said upper plenum, wherein said panel spans substantially the entire width of said upper plenum.

4. The fireplace of claim 1 wherein said at least one plenum further comprises a rear plenum and a lower plenum, wherein said rear plenum is disposed between an outer rear wall of said plurality of housing outer walls and said combustion chamber rear wall, wherein said lower plenum is disposed between an outer bottom wall of said plurality of housing outer walls and said combustion chamber bottom wall, and wherein said upper plenum, said rear plenum, and said lower plenum are arranged in flow communication to define a generally C-shaped cooling air passageway.

5. The fireplace of claim 4 wherein said cooling air inlet is in flow communication with said lower plenum, and wherein said cooling air inlet comprises an inlet into a room being heated by the fireplace.

6. The fireplace of claim 1 wherein said baffle further comprises vertically aligned, forwardly projecting flanges at respective baffle ends.

7. A fireplace for combusting fuel comprising:

a combustion chamber whereat the fuel is combusted and products of combustion are created, said combustion chamber comprising an intake opening through which combustion air is introduced and an exhaust onening through which the products of combustion are discharged, said combustion chamber further comprising a top wall, a bottom wall, side walls, and a rear wall;

a flue disposed in fluid communication with the exhaust opening of the combustion chamber for exhausting the products of combustion;

a housing comprising a plurality of outer walls including a top wall, a bottom wall, a rear wall, and a front wall, wherein said top wall, said bottom wall, and said rear wall are respectively disposed in spaced apart relationship with said combustion chamber top wall, bottom wall, and rear wall to form an upper plenum, a lower plenum, and a rear plenum, and wherein said lower plenum, said rear plenum, and said upper plenum define a generally C-shaped cooling air passageway;

an inlet for introducing cooling air from a room being heated to said cooling air passageway;

wherein said upper plenum, at a lower, forward portion thereof proximate said housing front wall, further comprises means for discharging cooling air from said upper plenum; and means for redirecting and moving the cooling air from said discharging means to said flue without passing the cooling air through said combustion chamber.

8. The fireplace of claim 7 wherein said cooling air redirecting and moving means comprises a cooling air baffle and a venturi passageway, wherein said venturi passageway is disposed above said combustion chamber and in communication with said flue, and wherein said cooling air baffle is disposed below said discharging means to redirect rearwardly into said venturi passageway cooling air passing from said discharging means.

9. The fireplace of claim 8 wherein said venturi passageway is rearwardly spaced from said cooling air baffle to define an aperture therebetween and wherein combustion products at the front of said combustion chamber are drawn into said venturi passageway through said aperture.

10. The fireplace of claim 7 further comprising a passageway constricting baffle disposed within a forward portion of said upper plenum and arranged to constrict a cross-sectional area of said upper plenum through which cooling air flows and force the flow of cooling air passing through said upper plenum upwardly toward said housing outer top wall.

11. A fireplace for combusting fuel comprising:

a combustion chamber whereat the fuel is combusted and products of combustion are created, said combustion chamber comprising an intake opening through which combustion air is introduced and an exhaust opening through which the products of combustion are discharged, said combustion chamber further comprising a top wall, a bottom wall, side walls, and a rear wall;

a flue into which pass the products of combustion to be exhausted, wherein said flue is disposed in fluid communication with the exhaust opening of the combustion chamber;

a housing comprising a plurality of outer walls including a top wall, a bottom wall, a rear wall, and a front wall, wherein said top wall, said bottom wall, and said rear wall are respectively disposed in spaced apart relationship with said combustion chamber top wall, bottom wall, and rear wall to form an upper plenum, a lower plenum, and a rear plenum, and wherein said lower plenum, said rear plenum, and said upper plenum define a generally C-shaped cooling air passageway for an induced draft of cooling air;

an inlet in said outer housing front wall for introducing cooling air from a room being heated to said lower plenum;

means for discharging cooling air from a lower, forward portion of said upper plenum proximate said housing front wall;

a venturi passageway external of said combustion chamber and in flow communication with said flue, said venturi passageway comprising an upstream end and a downstream end, wherein a relatively low pressure is created within said venturi passageway upstream end by flow of the products of combustion to said flue; and baffle means for redirecting the cooling air outlet from said discharging means to said venturi passageway downstream end, whereby said low pressure within said venturi passageway upstream end induces a draft of cooling air sequentially through said cooling air inlet, said C-shaped cooling air passageway, said discharging means and said venturi passageway and into said flue.

12. The fireplace of claim 11 wherein said venturi passageway upstream end is defined in part by a diverter plate rearwardly projecting into an exhaust flow path of the combustion products passing to said flue.

13. The fireplace of claim 11 further comprising a passageway constricting baffle disposed within a forward portion of said upper plenum, said baffle sized and arranged to constrict a cross-sectional area of said upper plenum through which cooling air flows and force the flow of cooling air passing through said upper plenum upwardly against the underside of said housing outer top wall.

* * * * *